United States Patent [19]

Buril

[11] 4,093,168

[45] June 6, 1978

[54] HANGER BRACKET

[76] Inventor: Robert T. Buril, 1753 James Rd., St. Paul, Minn. 55105

[21] Appl. No.: 825,919

[22] Filed: Aug. 19, 1977

[51] Int. Cl.[2] ..... A47F 7/28

[52] U.S. Cl. ..... 248/220.4; 211/57.1; 248/218.4; 248/300

[58] Field of Search ..... 211/57.1, 59.1; 248/220.2, 220.3, 220.4, 221.2, 221.1, 300, 243, 218.4, 73

[56] References Cited

U.S. PATENT DOCUMENTS

| | | | |
|---|---|---|---|
| 3,831,893 | 8/1974 | Zentar | 248/221.1 |
| 3,879,006 | 4/1975 | Staudte | 248/221.2 |
| 3,941,343 | 3/1976 | Kennedy | 248/220.3 |

*Primary Examiner*—Roy D. Frazier
*Assistant Examiner*—Robert W. Gibson, Jr.
*Attorney, Agent, or Firm*—Merchant, Gould, Smith, Edell, Welter & Schmidt

[57] ABSTRACT

A hardware item comprising a mounting strip for accepting supporting members designed for pegboard use, to obviate the need of the pegboard itself, and the combination of such a strip with such members. The strip is formed with mounting flanges spaced by bracket means of stepped configuration to provide first and second mounting surfaces perforated to receive the prongs of a supporting member.

7 Claims, 3 Drawing Figures

HANGER BRACKET

BACKGROUND OF THE INVENTION

This invention relates to the field of hardware and more particularly to hanger devices.

A well-known storage accessory comprises a sheet of perforated mounting board, with which a wide variety of hooks, hangers and supports have been adapted to cooperate. The board is of known thickness and has a regular field of perforations or at least one hooked or offset end arranged to pass through a hole in the mounting board and then bear against its outer or inner surfaces as well as the bottom of the hole or holes in question.

It is frequenty desirable to mount a single one of some kind of hook, hanger or support device, or a single vertical row of such devices, on a wall stud for example. The range of such devices designed for direct wall mounting is much more limited, however, than the range thereof designed for "pegboard" mounting.

SUMMARY OF THE INVENTION

The present invention comprises an arrangement in the form of a hanger strip by which a hardware item designed for use with perforated mounting board may be used without the need for installing a section of the board itself. The arrangement is indeed superior in load-carrying capacity to the pegboard itself and is capable of easy, convenient mounting without the need of any auxiliary spacers.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
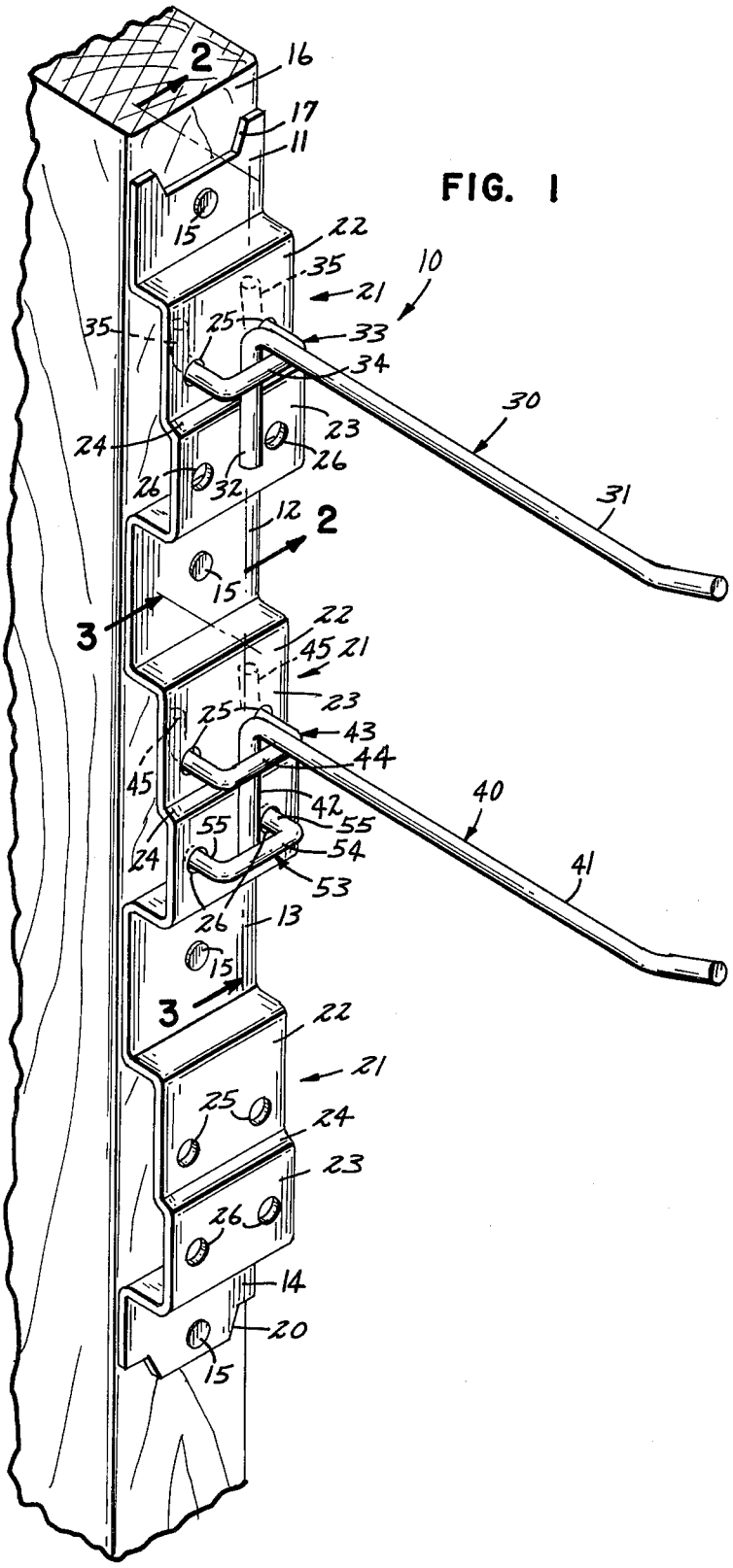
FIG. 1 is a perspective view of the invention in use.

As shown in the drawing, a mounting strip 10 according to the invention is formed of sheet metal, although other material such as appropriate plastics may be usable. The strip is provided with mounting flanges 11, 12, 13 and 14 which jointly define a reference surface for securing the strip by fasteners 15 in a desired position, such as on the edge of a wall stud 16.

Flanges 11 and 14 are formed with matching male and female configurations 17 and 20 to facilitate assembly of a plurality of strips 10 in end to end relation.

Between the flanges strip 10 is provided with a plurality of bracket means 21 each comprising a first, upper mounting surface 22 and a second, lower mounting surface 23 separated by a step 24 which is ordinarily horizontal. Surfaces 22 are spaced from the reference surface by a lesser distance than are surfaces 23: the distance *t* (see FIG. 2) is substantially equal to the thickness of a standard sheet of mounting board.

Formed in surface 22 are a first set of mounting holes 25 sized and spaced in accordance with the holes in the mounting board, and spaced equidistantly above step 24. A second set of holes 26 is formed in surface 23, spaced mutually and with respect to holes 24 in accordance with the hole spacing in the mounting board.

Figure 2:
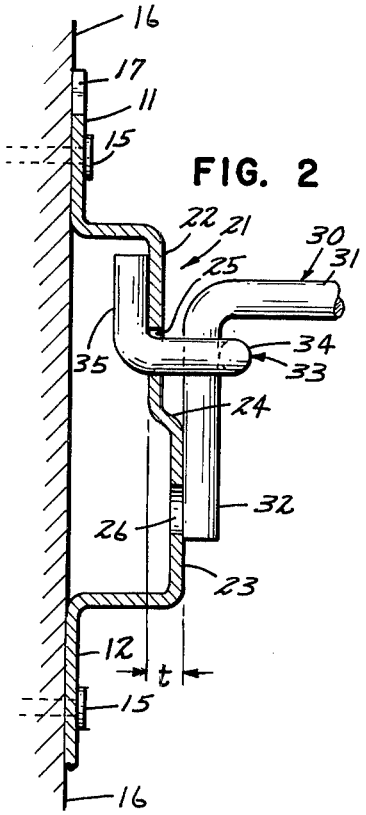
FIG. 2 is a fragmentary sectional view along the line 2—2 of FIG. 1.

A first typical support member 30 is shown in FIGS. 1 and 2 to be a rod-like element having a longer supporting component 31, a shorter reaction component 32, and a U-shaped prong component 33 having a bight portion 34 passing around and secured to component 32. The ends 35 of component 33 are sized and spaced to pass through holes 24, and are bent upward at right angles. The dimensions of the prong component 33 are such that when ends 35 pass through holes 24 and engage the back of mounting surface 22, reaction component 32 is parallel to and in lateral engagement with mounting surface 23.

Figure 3:
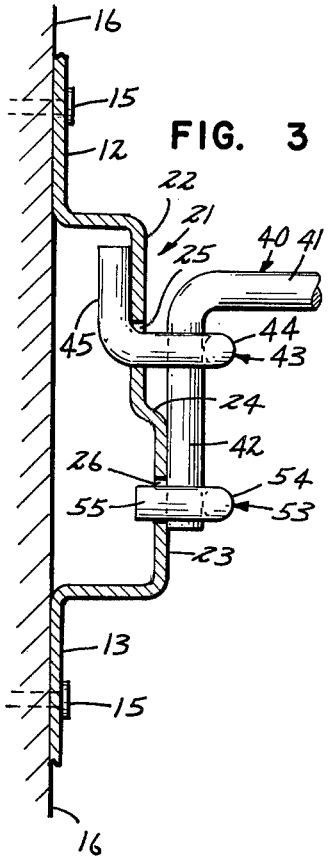
FIG. 3 is a fragmentary sectional view along the line 3—3 of FIG. 1.

A second typical support member 40 is shown in FIGS. 1 and 3 to be a rod-like element having a longer supporting component 41, a shorter reaction component 42, and a first prong component 43, like members 31, 32 and 33 respectively of member 30. Member 40 includes a second prong component 53 having a bight portion 54 passing around and secured to component 32. The ends 55 of component 53 are sized and spaced to pass through holes 26 when the ends 45 of bight portion 44 are engaged in holes 25 and thus stabilize the supporting member on the mounting surfaces.

From the foregoing it will be evident that I have invented a hardware element facilitating the use of pegboard hanger elements and obviating the need of installing pegboard sections themselves where their presence would be unwelcome.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. As a substitute for a perforated mounting board of known thickness and known hole spacing and sizing, a strip of substantially rigid sheet material having at least two mounting flanges to jointly define a reference surface, and having bracket means connected to and located between said flanges with a stepped configuration defining first and second mounting surfaces joined at a step and spaced at lesser and greater distances respectively from said reference surface, the difference between said distances being substantially said known thickness less the thickness of the sheet material, said first mounting surface being formed with a set of holes, spaced and sized to agree with said known hole spacing and sizing, at locations spaced from said step.

2. The structure of claim 1 in combination with a support member including a rod-like element having a longer supporting component, a shorter reaction component at right angles to said supporting component, and a U-shaped prong component including a pair of ends sized and spaced to pass through said mutually spaced holes and bent to thereafter engage laterally with the rear of said first mounting, the dimensions of said prong component being such that when said ends engage the rear of said first mounting surface, said reaction component is parallel to and in lateral engagement with said second mounting surface.

3. A structure according to claim 1 including a plurality of said mounting flanges, and further including bracket means with said step configuration between each pair of said flanges.

4. A structure according to claim 1 in which said second mounting surface is also formed with a set of holes, spaced and sized to agree with said known hole spacing and sizing, at locations spaced from said step.

5. The structure of claim 1 together with means securing said hanger strip on a vertical surface with said step and the line between said space holes extending horizontally.

6. Means for suspending a hanger designed for use with perforated mounting board of known thickness and known hole sizing and spacing, comprising:

a sheet metal bracket having a stepped configuration to define parallel first and second mounting surfaces;

the rear of said first surface being displaced from the front of said second surface by substantially said known thickness; and means mounting said bracket on a vertical surface with said first mounting surface above said second mounting surface, said first mounting surface being formed with a set of holes sized and spaced to agree with said known hole and spacing, at locations equidistant from the step between said mounting surfaces, and the thickness of said metal being sufficient to resist distortion by a load applied to a hanger inserted in said holes and bearing against said second mounting surface.

7. A structure according to claim 1 in which the end mounting flanges have matched male and female configurations to facilitate mounting a plurality of said strips in end to end relation.

* * * * *